US005914732A

United States Patent [19]

Sakai et al.

[11] Patent Number: 5,914,732

[45] Date of Patent: Jun. 22, 1999

[54] HEAD DRIVE WAVEFORM GENERATION DEVICE AND HEAD DRIVE WAVEFORM GENERATION METHOD

[75] Inventors: Kenichiro Sakai; Tsugio Noda, both of Kawasaki, Japan

[73] Assignee: Fujitsu Limited, Kawasaki, Japan

[21] Appl. No.: 08/724,896

[22] Filed: Oct. 3, 1996

[30] Foreign Application Priority Data

Nov. 6, 1995 [JP] Japan ..... 7-287569

[51] Int. Cl.[6] ..... B41J 29/38

[52] U.S. Cl. ..... 347/10; 347/184

[58] Field of Search ..... 347/9, 10, 184

[56] References Cited

U.S. PATENT DOCUMENTS 4,743,924 5/1988 Scardovi ..... 347/10

5,142,302 8/1992 Kano ..... 347/184

*Primary Examiner*—Christopher A. Bennett

*Attorney, Agent, or Firm*—Armstrong, Westerman, Hattori, McLeLand & Naughton

[57] ABSTRACT

A head drive waveform generation device and a head drive waveform generation method that do not require large-capacity memory during mounting on a printer are disclosed. The head drive waveform generation device generates and outputs, based on head drive waveform data consisting of a plurality of waveform data elements that comprise inclination values serving as information for specifying signal changes per unit of time, and interval widths serving as information for specifying time intervals during which the inclination values are used, head drive waveforms whose magnitude varies over time in accordance with the inclination values within the waveform data elements, during the time intervals specified by the interval widths within the waveform data elements.

16 Claims, 13 Drawing Sheets

| TIME | INCLINATION VALUES | INTERVAL WIDTHS | |
|---|---|---|---|
| 0 | 0 | 60 | $22_1$ |
| 60 | 50 | 40 | $22_2$ |
| 100 | | 80 | |
| 180 | −300 | 10 | $22_3$ |
| 190 | | 10 | |

| TIME | INCLINATION VALUES | INTERVAL WIDTHS | |
|---|---|---|---|
| 0 | 0 | 60 | $22_1$ |
| 60 | 50 | 40 | $22_2$ |
| 100 | 25 | 80 | $22_3$ |
| 180 | -300 | 10 | $22_4$ |
| 190 | -100 | 10 | $22_5$ |

HEAD DRIVE WAVEFORM GENERATION DEVICE AND HEAD DRIVE WAVEFORM GENERATION METHOD

BACKGROUND OF THE INVENTION

1. Field of the Invention

The present invention relates to a head drive waveform generation device and a head drive waveform generation method for generating head drive waveforms used for driving a print head.

2. Description of the Related Art

A print head used in an ink-jet printer is driven by head drive waveforms shaped as shown in FIG. 15. The head drive waveforms are sent to piezoelements inside the print head, and the piezoelements suction ink into the head when the head drive waveforms monotonically increase, and eject the ink contained in the head through a nozzle when the waveforms monotonically decrease.

Because the amount of ink ejected from the print head varies with the type of printing paper, the print density, and the like, it is necessary to present the print head with head drive waveforms whose form corresponds to the printing conditions. In addition, the amount of ink ejected from the print head during the transmission of a given head drive waveform depends on the type (characteristics) of ink used or on the ambient temperature.

With a printer having a print head such as that described above, therefore, it is desirable to present the print head with head drive waveforms that correspond to the printing conditions or the printing environment. For this reason, a conventional printer stores a plurality of pieces of head drive waveform data that determine the shape of the head drive waveforms. Such conventional printers, however, have been disadvantageous in that because data that specify the magnitudes (voltage values) of a waveform at moments separated by time intervals AT are used as the head drive waveform data, large-capacity memory is needed to store a plurality of pieces of head drive waveform data, with a resulting increase in the cost of printer manufacturing.

SUMMARY OF THE INVENTION

An object of the present invention is to provide a head drive waveform generation device and a head drive waveform generation method that do not require large-capacity memory during mounting on a printer.

The first head drive waveform generation device pertaining to the present invention comprises a storage unit for storing waveform data that express the positions of a plurality of points in time/signal value coordinates; and a waveform output unit for generating signals that express temporal changes in the signal values by means of a plurality of line segments obtained when the points whose positions are expressed by the waveform data stored in the storage unit are connected by line segments in the order of values along the time axis, and outputting the result as a head drive waveform.

Specifically, waveform data expressing the positions of a plurality of points in time/signal value coordinates are used as waveform data for expressing the shape of head drive waveforms in the first head drive waveform generation device. The waveform output unit determines, based on the waveform data, the signal values to be outputted during the time for which no definitions for the signal values are given by the waveform data, and outputs signals that express temporal changes by means of a plurality of line segments obtained when points whose positions are expressed by the waveform data are connected by line segments in the order of values along the time axis.

The second head drive waveform generation device pertaining to the present invention comprises a storage unit, a read unit, a generation unit, and a waveform output unit. The storage unit stores a plurality of waveform data elements that comprise inclination values, which provide information specifying signal changes per unit of time, and interval widths, which provide information specifying time intervals during which the inclination values are used. The read unit sequentially reads the plurality of waveform data elements stored in the storage unit. The generation unit generates digital signals whose magnitude varies over time in accordance with the inclination values within the waveform data elements that have been read by the read unit, during the time intervals specified by the interval widths within the waveform data elements. The waveform outputting means outputs, in the form of head drive waveforms, analog signals whose magnitude corresponds to the digital signals generated by the generation unit.

Specifically, a plurality of waveform data elements that comprise inclination values serving as information for specifying signal changes per unit of time, and interval widths serving as information for specifying time intervals during which the inclination values are used are employed as the shape of the head drive waveforms in the second head drive waveform generation device. The generation unit generates digital signals whose magnitude varies over time in accordance with the inclination values within the waveform data elements that have been sequentially read by the reading means, during the time intervals specified by the interval widths within the waveform data elements. Specifically, the generation unit generates, from the waveform data elements, digital signals whose magnitude changes can be approximated as a linear function of time. The waveform output unit converts the digital signals outputted by the generation unit to analog signals, and outputs the result.

The third head drive waveform generation device pertaining to the present invention comprises a storage unit, a read unit, a generation unit, and a waveform output unit. The storage unit stores a plurality of waveform data elements that comprise inclination values, which provide information specifying signal changes per unit of time, and several interval widths, which provide information corresponding to these inclination values and specifying the corresponding time intervals. The read unit sequentially reads the plurality of waveform data elements stored in the storage unit. The generation unit generates digital signals whose magnitude varies over time in accordance with the inclination values within the waveform data elements, during the time interval specified by the initial interval width, which is one of the several interval widths within the waveform data elements read by the read unit. The generation unit also generates digital signals whose magnitude varies over time in accordance with the results obtained by performing prescribed operations on the inclination values during the time interval specified by the second and subsequent interval widths within the waveform data elements. The waveform output unit outputs, in the form of head drive waveforms, analog signals whose magnitude corresponds to the digital signals generated by the generation unit.

Specifically, a plurality of waveform data elements that comprise inclination values serving as information for specifying signal changes per unit of time, and several interval widths serving as information for specifying the time intervals that correspond to these inclination values are used as the shape of the head drive waveforms in the third head drive waveform generation device. The generation unit generates digital signals whose magnitude varies over time in accordance with the inclination values within the waveform data elements during the time interval specified by the initial interval width within each waveform data element. The generation unit also generates digital signals whose magnitude varies over time in accordance with the results obtained by performing prescribed operations on the inclination values during the time interval specified by the second and subsequent interval widths within the waveform data elements. Specifically, the generation unit uses a single waveform data element to generate digital signals whose temporal changes can be approximated with the aid of continuous line segments equal in number to the interval widths contained in this waveform data element. The waveform output unit outputs, in the form of head drive waveforms, analog signals whose magnitude corresponds to the digital signals generated by the generation unit.

The following unit is adopted as the second or third head drive waveform generation device: a waveform output unit comprising a contrast conversion unit for extracting, from the significant bits of the digital signals generated by the generation unit, data whose number of bits corresponds to contrast-specifying data; and a signal conversion unit for outputting analog signals whose magnitude corresponds to the digital signals extracted by the contrast conversion unit.

DETAILED DESCRIPTION OF THE PREFERRED EMBODIMENTS

The present invention will now be described with reference to drawings.

Figure 1:
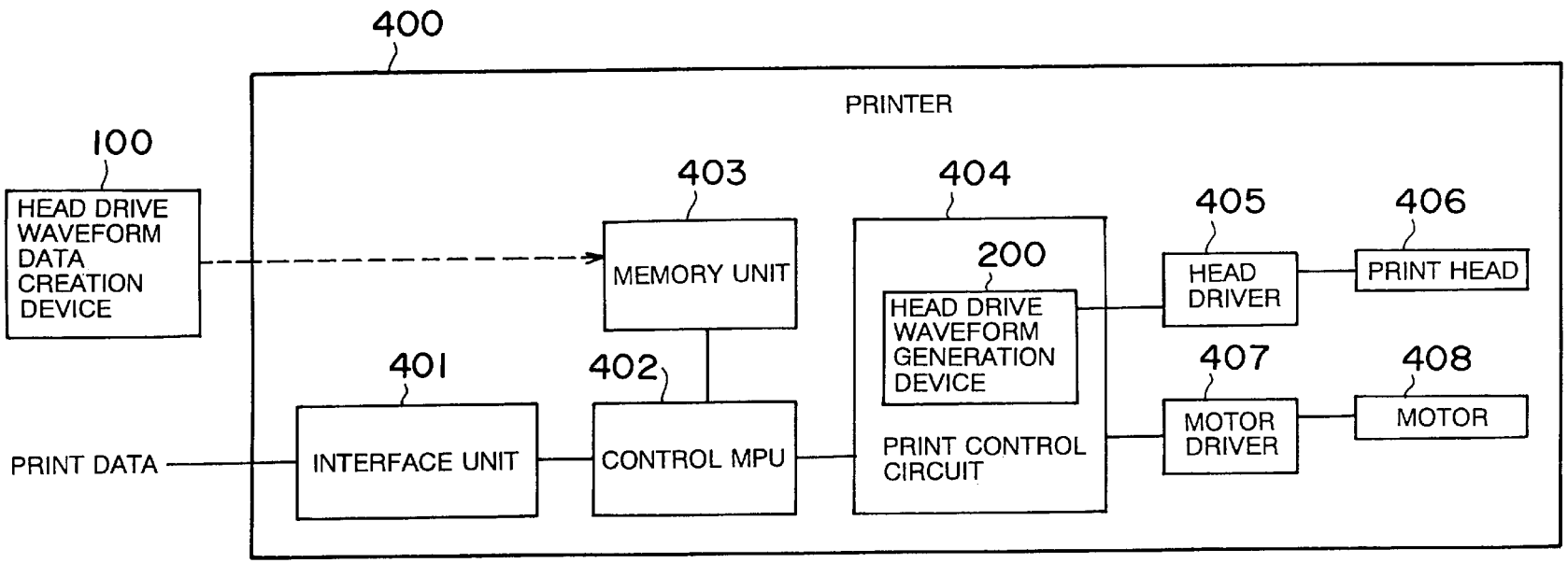
FIG. 1 is a block diagram depicting the structure of a printer equipped with the head drive waveform generation device pertaining to an embodiment.

FIG. 1 depicts the structure of a printer equipped with the head drive waveform generation device pertaining to the present invention.

As shown in the drawing, a printer 400 comprises an interface unit 401, a control MPU 402, a memory unit 403, and a print control circuit 404. The print control circuit 404 is connected to a print head (ink-jet head) 406 via a head driver 405, and to a motor 408 via a motor driver 407. In addition, the print control circuit 404 contains a head drive waveform generation device 200, which is a device for the actual generation of head drive waveforms.

Figure 2:
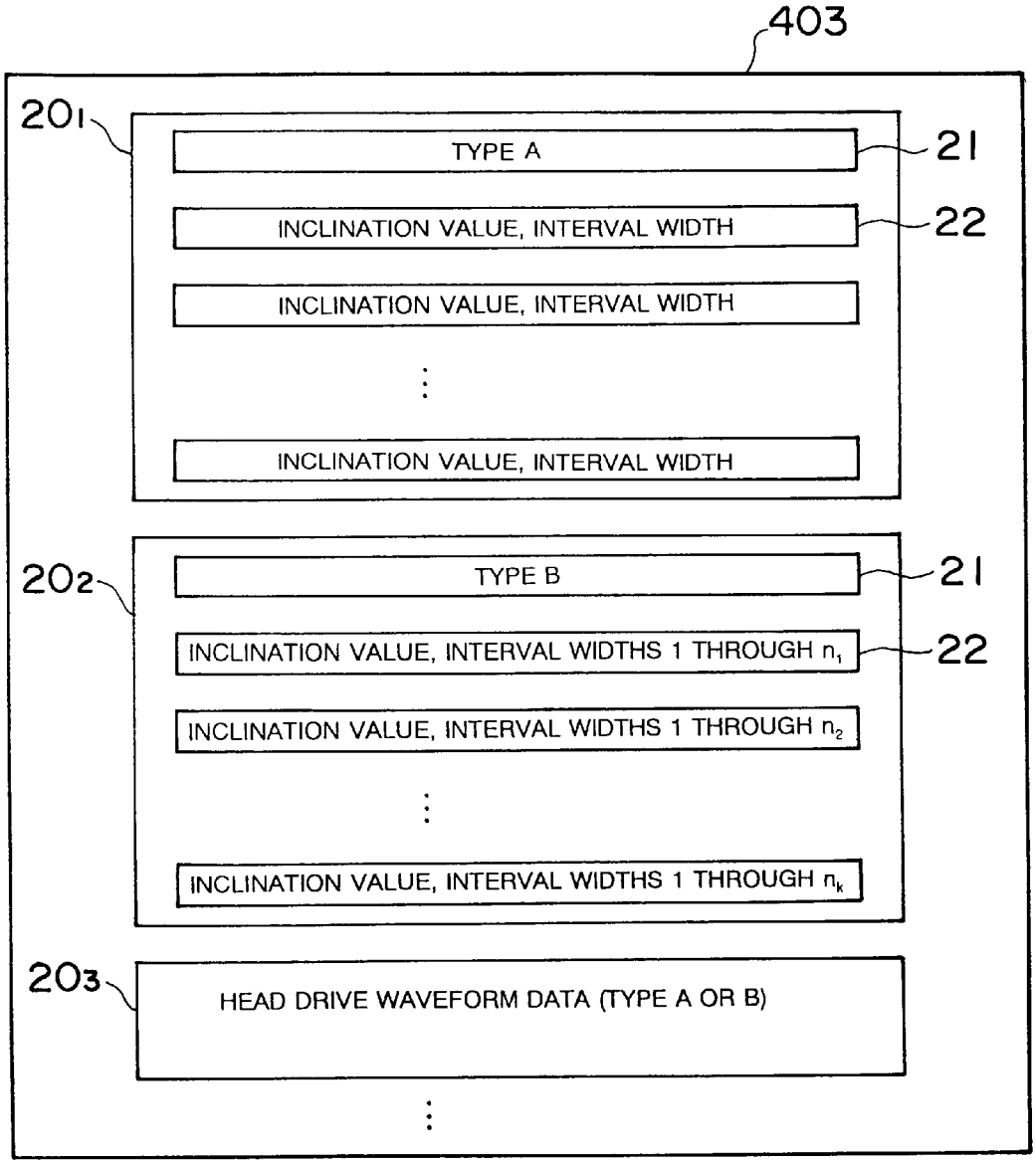
FIG. 2 is a diagram of the head drive waveform data stored in a memory unit.

The interface unit 401 is a circuit for controlling the timing of data exchange with external equipment (for example, a computer). The memory unit 403 comprises a magnetic disk storage device, RAM (random-access memory), and ROM (read-only memory). The memory unit 403 stores font sets or programs that specify the operating sequence of the control MPU 402. In addition, the memory unit 403 stores a plurality of pieces of head drive waveform data 20 that comprises mode data 21 and a plurality of waveform data elements 22, as schematically shown in FIG. 2. The head drive waveform data can be data (type A head drive waveform data) in the form of a stored waveform data element 22 consisting of an inclination value and an interval width, such as head drive waveform data $\mathbf{20}_1$, or data (type B head drive waveform data) in the form of a waveform data element 22 consisting of an inclination value and several interval widths, such as head drive waveform data $\mathbf{20}_2$. These pieces of head drive waveform data are created in a head drive waveform data creation device 100 and stored in the memory unit 403 during the manufacture of the printer 400. Details related to the head drive waveform data and the head drive waveform data creation device 100 are described below.

The control MPU 402, which is a control circuit for controlling the entire printer 400, operates in accordance with a program stored in the memory unit 403. Upon receipt of a command specifying the printing conditions via the interface unit 401, the control MPU 402 presents the print control circuit 404 with data that correspond to this command. When, for example, a command specifying a change in the head drive waveform data being used is received, the head drive waveform data corresponding to this command are read from the memory unit 403 and sent to the print control circuit 404 (head drive waveform generation device 200). When a contrast-specifying command is received, the control MPU 402 sends print data to the print control circuit 404.

The print control circuit 404, which is a control circuit for controlling the print head (ink-jet head) 406 and the motor 408 for driving the position control mechanism (not shown) of the print head 406, is based on a DSP (digital signal processor). Upon receipt of print data, the print control circuit 404 designates, based on these print data, driving piezoelements from among the plurality of piezoelements provided to the print head 406. The print control circuit 404 communicates the specification results (data specifying the piezoelements) to the head driver 405, and the head drive waveform generation device 200 is instructed to output a head drive waveform.

Figure 3:
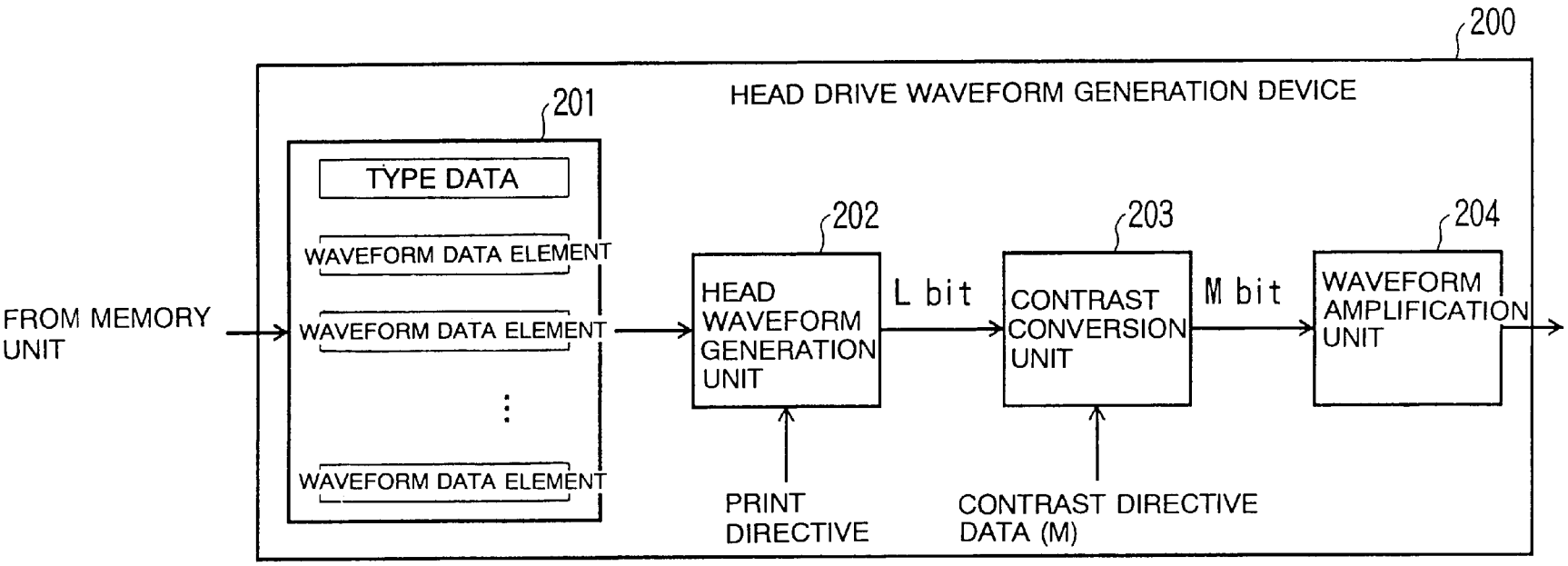
FIG. 3 is a functional block diagram of a head drive waveform data creation device.

FIG. 3 shows the head drive waveform generation device 200. The head drive waveform generation device 200 comprises a head drive waveform data storage unit 201, a head drive waveform generation unit 202, a contrast conversion unit 203, and a waveform amplification unit 204, as shown in the drawing.

The head drive waveform data storage unit 201 stores a piece of head drive waveform data (type data and a plurality of waveform data elements) selected from amount the plurality of pieces of head drive waveform data stored in the memory unit 403. When instructed to output a head drive waveform, the head drive waveform generation unit 202 generates, based on the head drive waveform data stored in the head drive waveform data storage unit 201, L-bit digital data whose content varies with time (the details will be described below). The contrast conversion unit 203 outputs the significant M bits of the L-bit digital data generated by the head drive waveform generation unit 202. The waveform amplification unit 204 outputs an analog signal obtained by forming an $A\times 2^L/2^M$ multiple of the digital data outputted by the contrast conversion unit 203. The contrast conversion unit 203 operates upon receipt of contrast-specifying data, which are data that specify M.

Specifically, the head drive waveform generation device 200, under control from the print control circuit 404, generates head drive waveforms whose form corresponds to the head drive waveform data, and sends the resulting head drive waveform to the head driver 405.

As a result, the head drive waveform generated by the head drive waveform generation device 200 is sent to several piezoelements inside the print head 406 by the head driver 405, and printing is performed by the print head 406.

Printing is performed in accordance with the print data as a result of the fact that the print control circuit 404 alternates in repeating control such as that described above and control over the printing position of the print head 406 due to the output of control signals to the motor driver 407.

The operation of the head drive waveform generation device 200 will now be described in detail. First, a detailed description of the head drive waveform data will be given.

Figure 4:
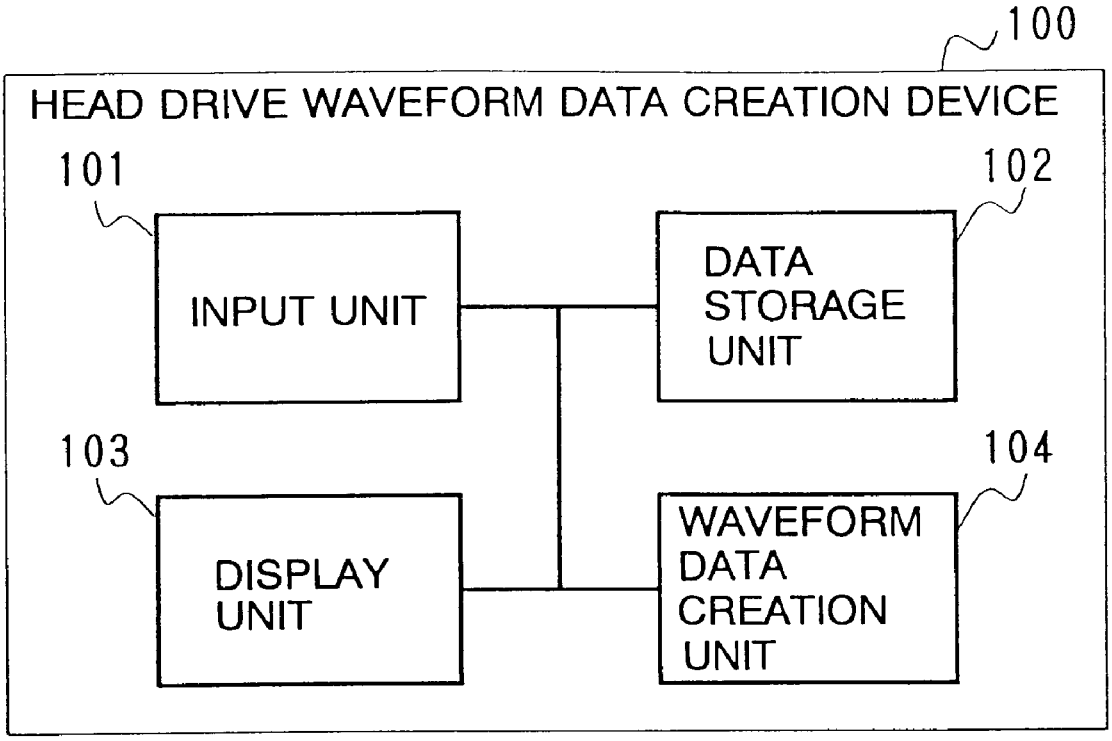
FIG. 4 is a flow chart of type A data creation and processing performed in the head drive waveform data creation device.

The head drive waveform data used by the head drive waveform generation device 200 is created by the head drive waveform data creation device 100. The head drive waveform data creation device 100 comprises an input unit 101, a data storage unit 102, a display unit 103, and a waveform data creation unit 104, as shown in FIG. 4. The head drive waveform data creation device 100 is a so-called computer, the input unit 101 corresponds to a keyboard and a mouse, and the data storage unit 102 corresponds to a magnetic storage device. In addition, the display unit 103 corresponds to a CRT display, and the waveform data creation unit 104 corresponds to a CPU and peripheral circuits (ROM, RAM).

When using the head drive waveform data creation device 100, an operator stores (in the data storage unit 102) raw data concerning the head drive waveforms for creating head drive waveform data (time-sequence data concerning voltage values). The operator then uses the input unit 101 to input a command that specifies the creation of waveform data and raw data-specifying information that specifies the target raw data. Because, as has already been outlined, head drive waveform data can be type A head drive waveform data or type B head drive waveform data, the operator, after specifying the raw data, presents the input unit 101 with a command that specifies which type of head drive waveform data to create.

When raw data-specifying information has been inputted into the waveform data creation unit 104, the raw data identified by the raw data-specifying information are read from the data storage unit 102, and the shape of the current data thus read out is displayed by the display unit 103. The waveform data creation unit 104 performs type A data creation and processing when the creation of type A head drive waveform data has been specified, and type B data creation and processing when the creation of type B head drive waveform data has been specified.

Type A data creation and processing will first be described using FIGS. 5 and 6. Of these drawings, FIG. 5 is a flow chart depicting the operating sequence of the waveform data creation unit 104 during type A data creation and processing, and FIG. 6 is a diagram illustrating the relation between the data that are inputted by the operator and the data that are computed by type A data creation and processing.

Figure 5:
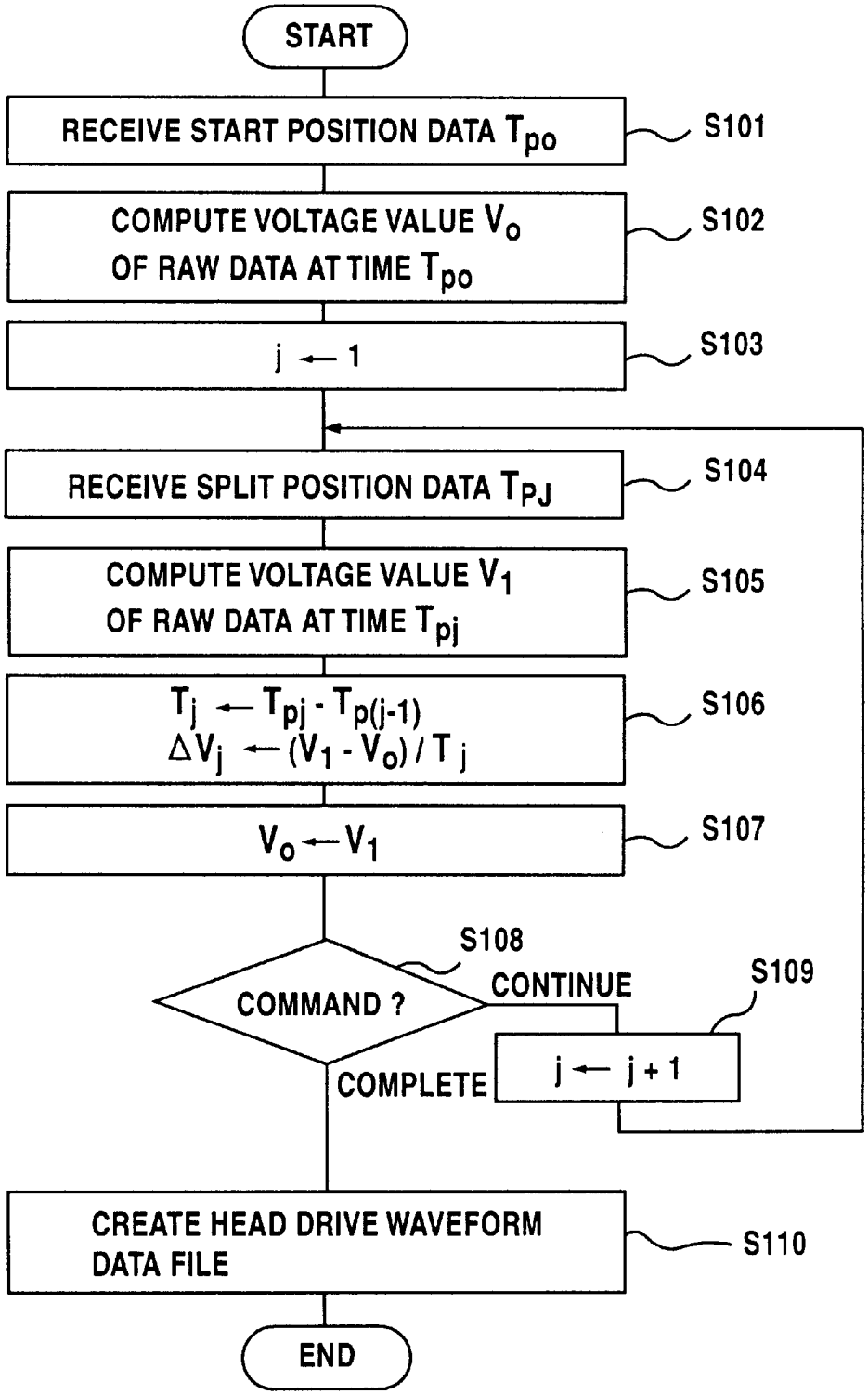
FIG. 5 is a diagram illustrating type A data creation and processing performed in the head drive waveform data creation device.

As shown in FIG. 5, during type A data creation and processing the waveform data creation unit 104 receives start position data $T_{p0}$, that is, the value of the time coordinate for raw data, from the operator via the input unit 101 (step S101). The waveform data creation unit 104 then determines the voltage value $V_0$ at the time indicated by the start portion data $T_{p0}$ (step S102), and assigns "1" to the variable j (step S103). The waveform data creation unit 104 receives split position data $T_{pj}$ from the operator (step S104) and determines a voltage value $V_1$ that corresponds to the split position data $T_{pj}$ (step S105). The waveform data creation unit 104 then assigns $T_{pj}-T_{p(j-1)}$ and $(V_1-V_0)/(T_{pj}-T_{p(j-1)})$ to $T_j$, which is a variable for storing the j-th interval width, and to $\Delta V_j$, which is a variable for storing the j-th inclination value, respectively (step S106). During this step, the waveform data creation unit 104 also performs processing to enable a straight line connecting the points $(T_{p(j-1)}, V_0)$ and $(P_{pj}, V_1)$ to be displayed by the display unit 103.

Figure 6A:
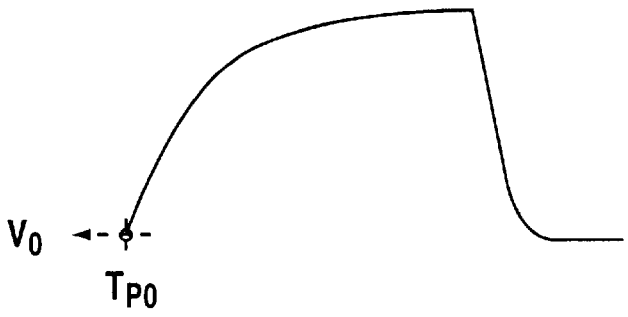
FIG. 6 is a flow chart of type B data creation and processing performed in the head drive waveform data creation device.
Figure 6B:
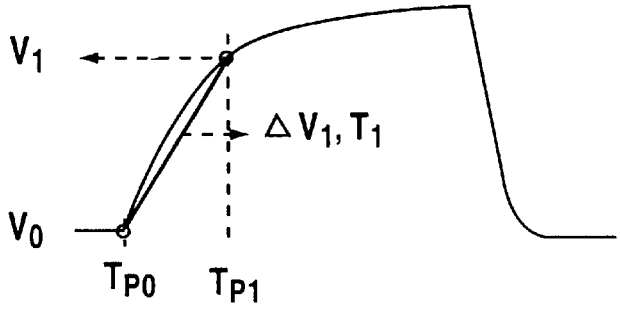

Specifically, the start position data $T_{p0}$ are received from the operator and a voltage value $V_0$ that corresponds to $T_{p0}$ are computed during steps S101 and S102, as shown in FIG. 6*a*. During the steps S104 through S106 that are performed immediately thereafter, the split position data $T_{p1}$ is obtained from the operator, and a voltage value $V_1$ that corresponds to $T_{p1}$ is computed, as are the length $T_1$ in the direction of the time axis and the slope $\Delta V_1$ for the line segment that connects the points $(T_{p0}, V_0)$ and $(T_{p1}, V_1)$ in time/voltage coordinates, as shown in FIG. 6*b*.

Reverting to FIG. 5, the description of the operation of the waveform data creation unit 104 will now be continued. Following the computation of $\Delta V_1$ and $T_{p1}$, the waveform data creation unit 104 assigns a value $V_1$ to $V_0$ (step S107). The waveform data creation unit 104 then assumes a state in which a command input is awaited, adds "1" to j (step S109) when a command specifying continued processing has been received (step S108), and returns to step S104. During step S108, the waveform data creation unit 104 repeats such processing until a termination-specifying command is inputted.

Figure 6C:
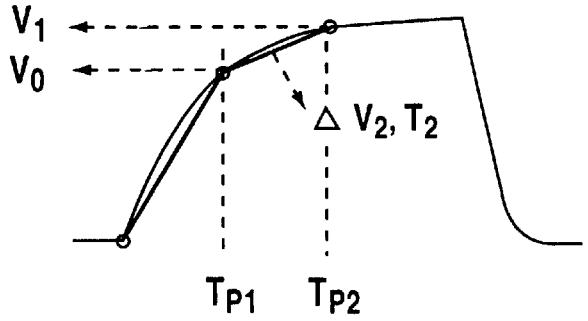
Figure 6D:
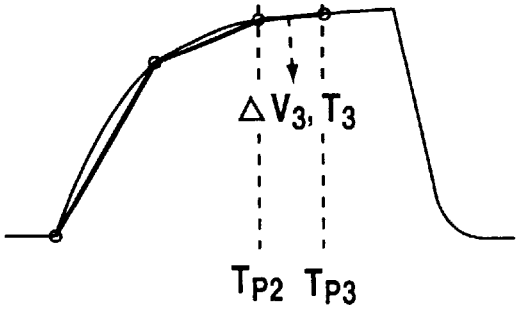

Specifically, during steps S104 through S107, which are performed while j is in a state of 2 or greater, the length $T_{pj}$ in the direction of the time axis and the slope $V_1$ are computed for the line segment that connects the point $(T_{p(j-1)}, V_0)$ determined by the previously received data $T_{p(j-1)}$ and the computed $V_1$, and the point $(T_{pj}, V_1)$ determined by the newly received and computed data, as shown in FIGS. 6*c* and 6*d*.

When termination has been specified (step S109; end), the waveform data creation unit 104 creates (step S110), in the data storage unit 101, a head drive waveform data file containing the computed values $\Delta V_i$ and $T_i$ (i=1 through j) and the type data that express type A, and type A data creation and processing are completed.

During step S110, the waveform data creation unit 104 creates a file alternately containing 2-byte ΔV and 2-byte T following 1-byte type data. Specifically, the waveform data creation unit 104 creates files in which the delimiters for each piece of data can be identified by size.

Type B data creation and processing will now be described using FIGS. 7 and 8. Of these drawings, FIG. 7 is a flow chart depicting the operating sequence of the waveform data creation unit 104 during type B data creation and processing, and FIG. 8 is a diagram illustrating the relation between the data inputted by the operator and the data computed by type A data creation and processing.

Figure 7:
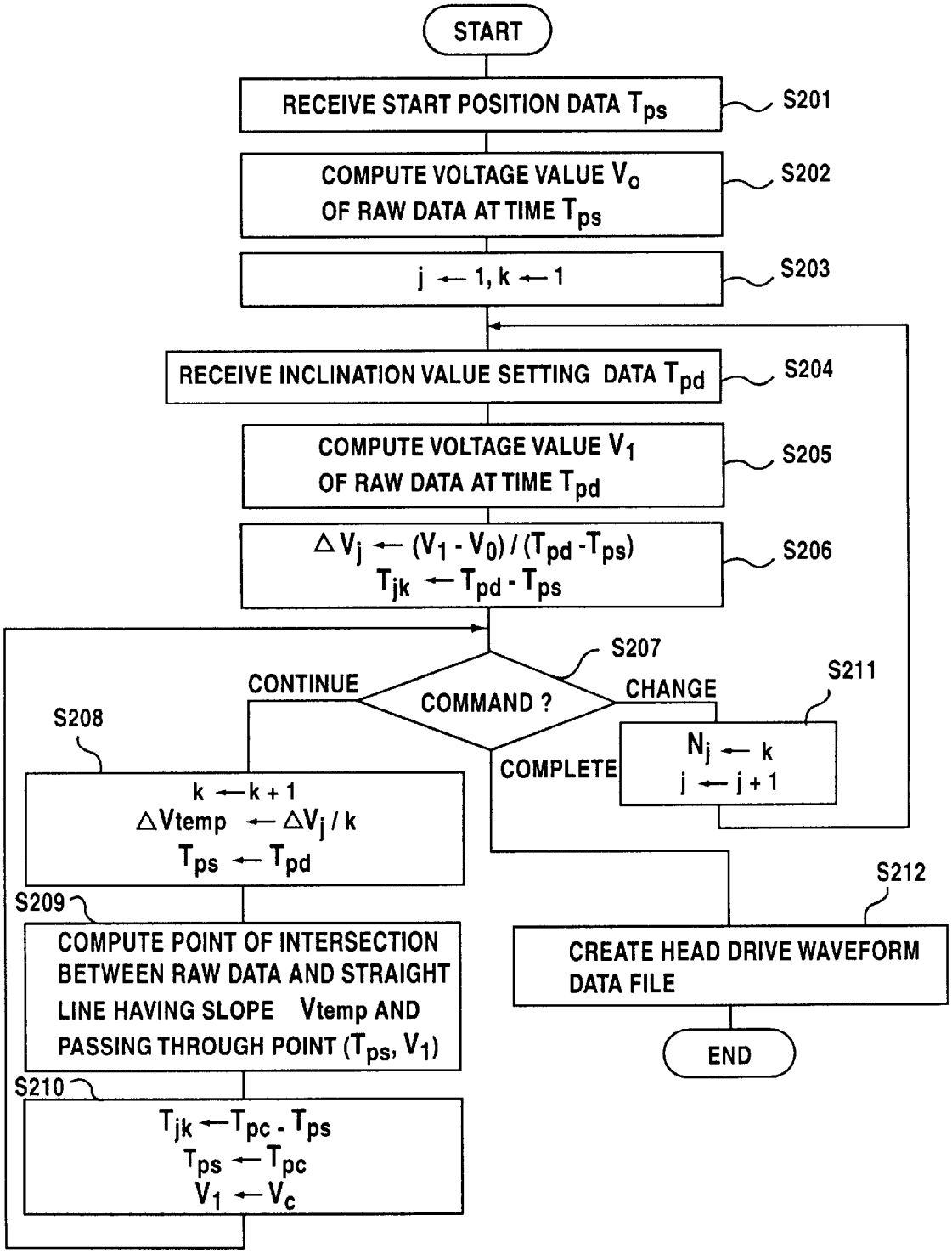
FIG. 7 is a diagram illustrating type B data creation and processing performed in the head drive waveform data creation device.

During type B data creation and processing, the waveform data creation unit 104 first receives start position data $T_{ps}$, which are time coordinate values of raw data, from the input unit 101, as shown in FIG. 7 (step S201). The waveform data creation unit 104 subsequently computes the voltage value $V_0$ of the raw data at the time indicated by the start position data $T_{ps}$ (step S202) and assigns "1" both to the variable j and to the variable k (step S203).

The waveform data creation unit 104 then obtains inclination value setting data $T_{pd}$, which are time coordinate values of raw data, from the input unit 101 (step S204) and computes the voltage value $V_1$ of the raw data at the time specified by the inclination value setting data $T_{pd}$ (step S205). The waveform data creation unit 104 subsequently assigns $(V_1-V_0)/(T_{pd}-T_{ps})$ to $\Delta V_j$, which is a variable for storing the j-th inclination value, and assigns $T_{pd}-T_{ps}$ to $T_{jk}$, which is a variable for storing the k-th interval width that corresponds to the j-th inclination value (step S206). During this step, the waveform data creation unit 104 also performs processing to enable the straight line connecting the points $(T_{ps}, V_0)$ and $(T_{ps}, V_1)$ to be displayed by the display unit 103.

Figure 8A:
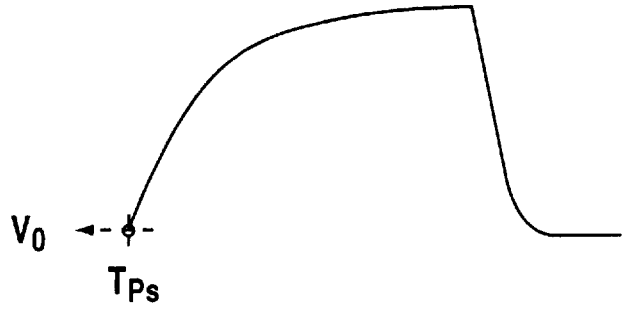
FIG. 8 is a diagram depicting the structure of type B head drive waveform data.
Figure 8B:
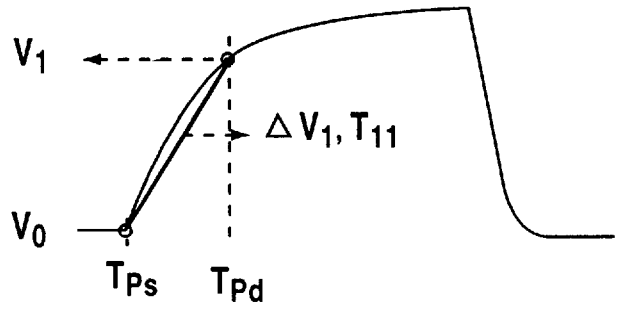

Specifically, the start position data $T_{ps}$ are obtained from the operator and the voltage value $V_0$ corresponding to $T_{ps}$ is computed during steps S101 and S202, as shown in FIG. 8*a*. During the steps S204 through S206 that are performed immediately thereafter, the split position data $T_{pd}$ are obtained from the operator, and a voltage value $V_1$ that corresponds to $T_{pd}$ is computed, as are the length $T_{11}$ in the direction of the time axis and the slope $\Delta V_1$ for the line segment that connects the points $(T_{ps}, V_0)$ and $(T_{pd}, V_1)$ in time/voltage coordinates, as shown in FIG. 7*b*.

Reverting to FIG. 7, the description of the operation of the waveform data creation unit 104 will now be continued. After the computation of $\Delta V_1$ and $T_{11}$ has been completed, the waveform data creation unit 104 assumes a state in which a command input is awaited (step S207).

When an operation specifying "continue" has ben performed for the input unit 101 (step S207; continue), the waveform data creation unit 104 adds one to k and assigns $\Delta V_j$/k and $T_{pd}$ to ΔVtemp and $T_{ps}$, respectively (step S208). Although this is not shown in the drawings, the waveform data creation unit 104 assigns $\Delta V_j$/(k+1) to ΔVtemp when $\Delta V_j$ has a negative value during step S208.

The waveform data creation unit 104 subsequently computes the point of intersection $(T_{pc}, V_c)$ between the waveform that is expressed by raw data and the straight line that starts at the point $(T_{ps}, V_1)$ and has the slope ΔVtemp (step S209). At this time, the waveform data creation unit 104 performs processing to enable this straight line to be displayed by the display unit 103. The waveform data creation unit 104 then assigns $T_{pc}-T_{ps}$, $T_{pc}$, and $V_c$ to $T_{jk}$, $T_{ps}$, and $V_1$, respectively (step S210), and returns to step S207.

Figure 8C:
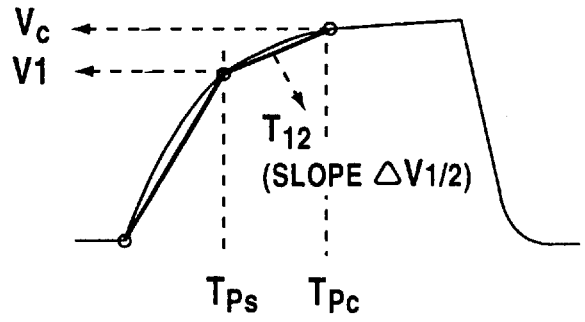
Figure 8D:
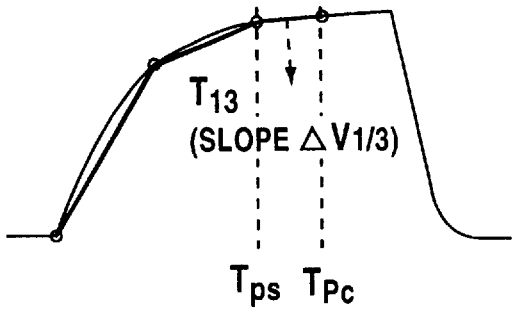

Specifically, in a loop extending from step S207 to step S210, the slope ΔVtemp of the line segment for approximating a portion of raw data is determined on the basis of $\Delta V_j$ and k without any new data being received from the operator, and this ΔVtemp is used to compute $T_{jk}$ (length in the direction of the time axis) for the line segment, as schematically shown in FIGS. 8*c* and 8*d*.

The operator performs an operation that specifies "continue" every time a new line segment is displayed, and performs an operation that specifies "change the inclination value" for the input unit 101 when the line segment has reached a point at which the voltage value starts decreasing. Although this is not shown in the figure, the waveform data creation unit 104 reduces k by 1 and then performs step S207 when an operation specifying "redo" has been performed during step S207. Specifically, the operator performs an operation that specifies "redo" for the input unit 101 and then performs an operation that specifies "change the inclination value" when the line segment displayed has approximated the raw data.

When an operation that specifies "change the inclination value" has been performed in the input unit 101 (step S207; change), the waveform data creation unit 104 assigns the value of the variable k to the variable $N_j$, adds "1" to j (step S211), and returns to step S204. Specifically, the waveform data creation unit 104 stores the number of interval widths $T_{jk}$ corresponding to the j-th inclination value for the variable $N_j$, and repeats the above-described processing once the end position of the last determined line segment has been reached.

When an operation that specifies "end" has been performed in the input unit 101 following the computation of $T_{jk}$ (step S210; end), the waveform data creation unit 104 creates a head drive waveform data file in the data storage unit 101 (step S212), and type B data creation and processing are completed.

Figure 9:
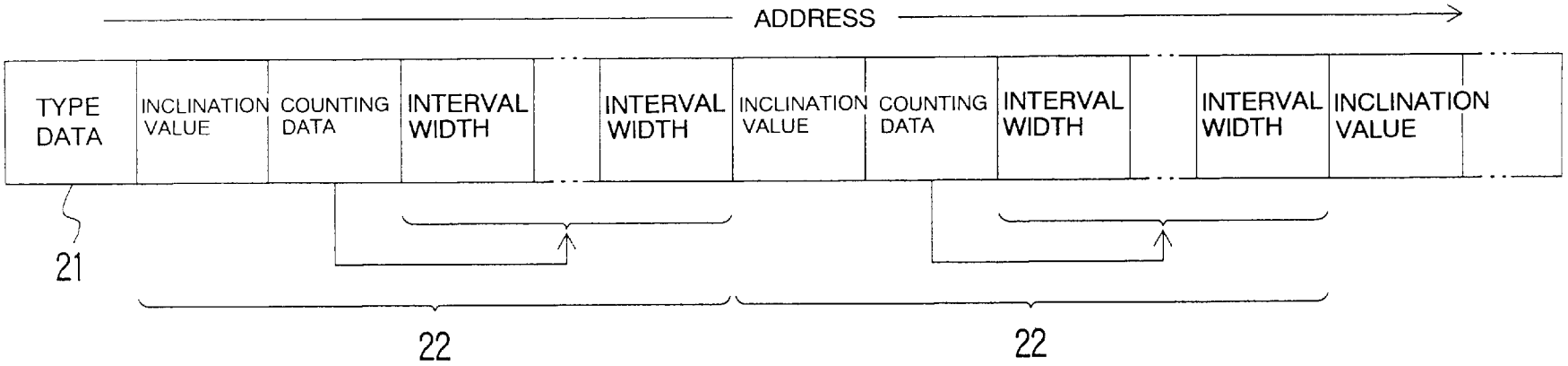
FIG. 9 is a block diagram depicting the structure of the head drive waveform generation device pertaining to an embodiment.

During step S212, the waveform data creation unit 104 creates a file in which 1-byte type data 21 are stored at the top, and waveform data elements 22 are repeatedly stored. As schematically shown in FIG. 9, a waveform data element 22 comprises a 2-byte inclination value (ΔVi value), 1-byte counting data (Ni value), and an Ni number of 2-byte data interval widths ($Ti_k$: k=1 to Ni). Specifically, the waveform data creation unit 104 creates files in which the delimiters for each piece of data can be identified by data size and counting data.

The memory unit 403 inside the printer 400 stores the multiple pieces of head drive waveform data thus created, and the head drive waveform data storage unit 201 of the head drive waveform generation device 200 stores copies of some of the pieces of head drive waveform data stored in the memory unit 403.

The head drive waveform generation unit 202 inside the head drive waveform generation device 200 performs processing that corresponds to the type data stored in the head drive waveform data storage unit 201 when a directive to output a head drive waveform has been sent out.

Figure 10:
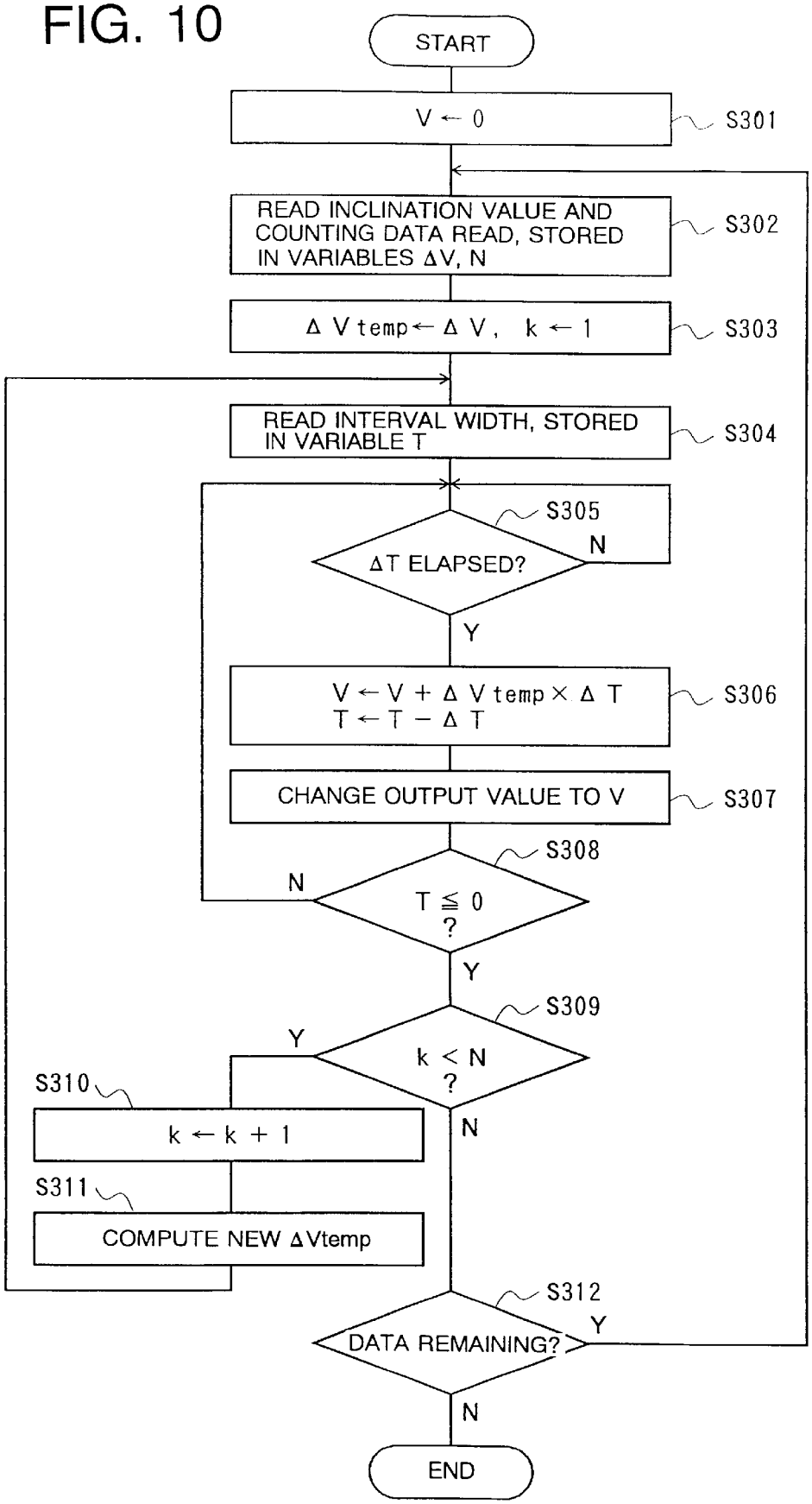
FIG. 10 is a flow chart depicting the operating sequence of the head drive waveform generation device when type B head drive waveform data have been presented.

First, the operating sequence of the head drive waveform generation unit 202 will be described using FIG. 10 for a case in which type B head drive waveform data have been stored.

In this case, the head drive waveform generation unit 202 assigns "0" to V, which is a variable for specifying the value of the digital signal being outputted (step S301). The head drive waveform generation unit 202 reads inclination values and counting data from the initial waveform data elements stored in the waveform data storage unit 201, and the pieces of data thus read out are stored in the variable ΔV and the variable N, respectively (step S302). The head drive waveform generation unit 202 subsequently assigns the variable ΔVtemp to the value ΔV, and "1" to the variable k (step S303).

The head drive waveform data 20 reads the next stored interval width of counting data and stores the result in the variable T (step S304). The head drive waveform generation unit 202 subsequently waits until time ΔT has elapsed (step S305; N). When ΔT has elapsed (step S305; Y), the head drive waveform generation unit 202 adds ΔVtemp×ΔT to V, subtracts ΔT from T (step S306), and changes the output value to V (step S307).

The head drive waveform generation unit 202 subsequently determines whether or not T is "0" or less, and returns to step S305 if T is not "0" or less (step S308; N). On the other hand, when T is "0" or less (step S307; Y), the head drive waveform generation unit 202 determines whether or not k is equal to or less than N (step S309). If k is equal to or less than N (step S308; Y), the head drive waveform generation unit 202 adds "1" to k (step S310) and computes a new ΔVtemp on the basis of ΔV and K (step S311). During step S311, the head drive waveform generation unit 202 determines ΔVtemp with the aid of the formula ΔVtemp=ΔV/K when ΔV is positive, and determines AVtemp with the aid of the formula ΔVtemp=ΔV/(k+1) when ΔV is negative.

The head drive waveform generation unit 202 then repeats processing starting from step S304.

The head drive waveform generation unit 202 repeats such processing until it is completed for all the interval widths within a single piece of waveform data (that is, until N=k). When N=k (step S309; N), it is determined whether or not unused waveform data elements have remained in the waveform data storage unit 201 (step S312). If such unused waveform data elements have remained (step S312; Y), the head drive waveform generation unit 202 returns to step S302 and starts processing the next waveform data element.

The head drive waveform generation unit 202 completes head drive waveform creation and processing if no unused waveform data elements have remained in the waveform data storage unit 201 (step S312; N).

Figures 11, 12:
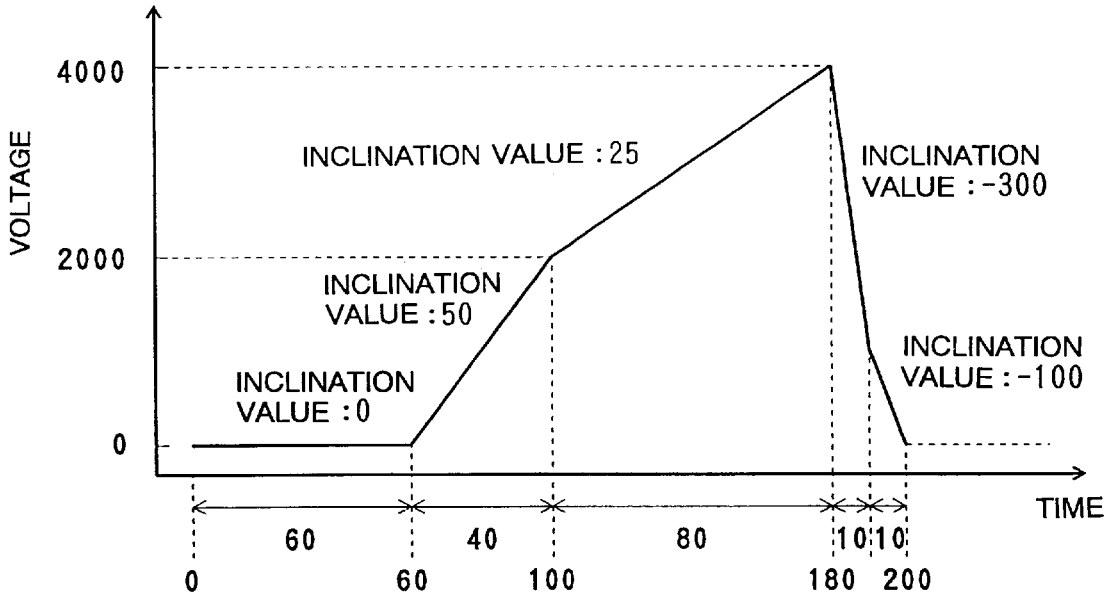
FIG. 11 is a diagram depicting an example of a waveform data element contained in type B head drive waveform data.
FIG. 12 is a diagram depicting a head drive waveform generated based on the head drive waveform data shown in FIG. 11.

The operation of the head drive waveform generation unit 202 will now be described in more detail with reference to FIGS. 11 and 12 for a case in which type B head drive waveform data have been sent out. FIG. 11 is a diagram depicting an example of type B head drive waveform data, and FIG. 12 is a diagram depicting a head drive waveform generated based on these head drive waveform data. As described above, counting data are contained in the waveform data elements 22 of the type B head drive waveform data, but these counting data are not depicted in FIG. 11.

The head drive waveform generation unit 202 first assigns the inclination value of "0" within the a waveform data element $\mathbf{22}_1$ to ΔV and ΔVtemp, and the interval width of "60" within the waveform data element $\mathbf{22}_1$ to T if a directive has been issued to output head drive waveform data such as that shown in FIG. 11 when these data have been sent out. The head drive waveform generation unit 202 executes a loop containing steps S305 through S308. As a result, a signal of constant voltage is sent to the print head (head driver) for a time interval of 0 to 60, as shown in FIG. 12.

Because the initial waveform data element $\mathbf{22}_1$ contains only one interval width, the relation N=k is satisfied during a stage at which the loop containing steps S305 through S308 has been extracted. As a result, the head drive waveform generation unit 202 branches toward the "N" side during step S309. In addition, waveform data elements have remained, so the head drive waveform generation unit 202 branches toward the "Y" side during step S312. Specifically, the head drive waveform generation unit 202 starts processing a waveform data element $\mathbf{22}_2$ following a continued output of "0" for the time interval of 0 to 60.

At the start of this processing, the head drive waveform generation unit 202 sets ΔV and ΔVtemp at the inclination value of "50" within the waveform data element $\mathbf{22}_2$, and T at the initial interval width of "40" within the waveform data element $\mathbf{22}_2$. The head waveform generation unit 202 performs the loop containing steps S305 through S308. As a result, a signal whose magnitude changes by 50×ΔT with every ΔT interval is sent to the print head (head driver) for a time interval of 60 to 100, as shown in FIG. 12.

Because the waveform data element $\mathbf{22}_2$ contains two interval widths, the relation N>k is satisfied during a stage at which the loop containing steps S305 through S308 has been extracted. As a result, the head drive waveform generation unit 202 branches toward the "N" side during step S309, and sets ΔVtemp at 50/2 (=ΔV/k), and T at he second interval width of "80" within the waveform data element $\mathbf{22}_2$. The head drive waveform generation unit 202 uses these data to repeat the loop containing steps S305 through S308. As a result, a signal whose magnitude changes by 25×ΔT with every ΔT interval is sent to the print head (head driver) for a time interval of 100 to 180, as shown in FIG. 12.

The relation N=k is satisfied following the completion of the aforementioned loop. As a result, the head drive waveform generation unit 202 returns to step S302 and starts processing a waveform data element $\mathbf{22}_3$. Because the waveform data element $\mathbf{22}_3$ also contains two interval widths, the head drive waveform generation unit 202 branches toward the "Y" side during step S309 after processing has been completed for the first interval width within the waveform data element $\mathbf{22}_3$ in the same manner as it was done during the processing of the waveform data element $\mathbf{22}_2$. The head drive waveform generation unit 202 calculates, based on ΔV (=−300) and k (=2), the ΔVtemp used with the second interval width, and executes the loop containing steps S305 through S308 by employing the calculated Δvtemp (=−100=ΔV/(k+1)) and using the second interval width ("10") within the waveform data element $\mathbf{22}_3$ as T. During the stage at which the execution of the loop has been accomplished, no more waveform data elements are left, and the processing is completed.

Specifically, a signal whose magnitude changes by −300×ΔT with every ΔT interval is sent to the print head (head driver) for a time interval of 180 to 190, and a signal whose magnitude changes by −100×ΔT with every ΔT interval is sent for a time interval of 190 to 200, as shown in FIG. 12.

Figure 13:
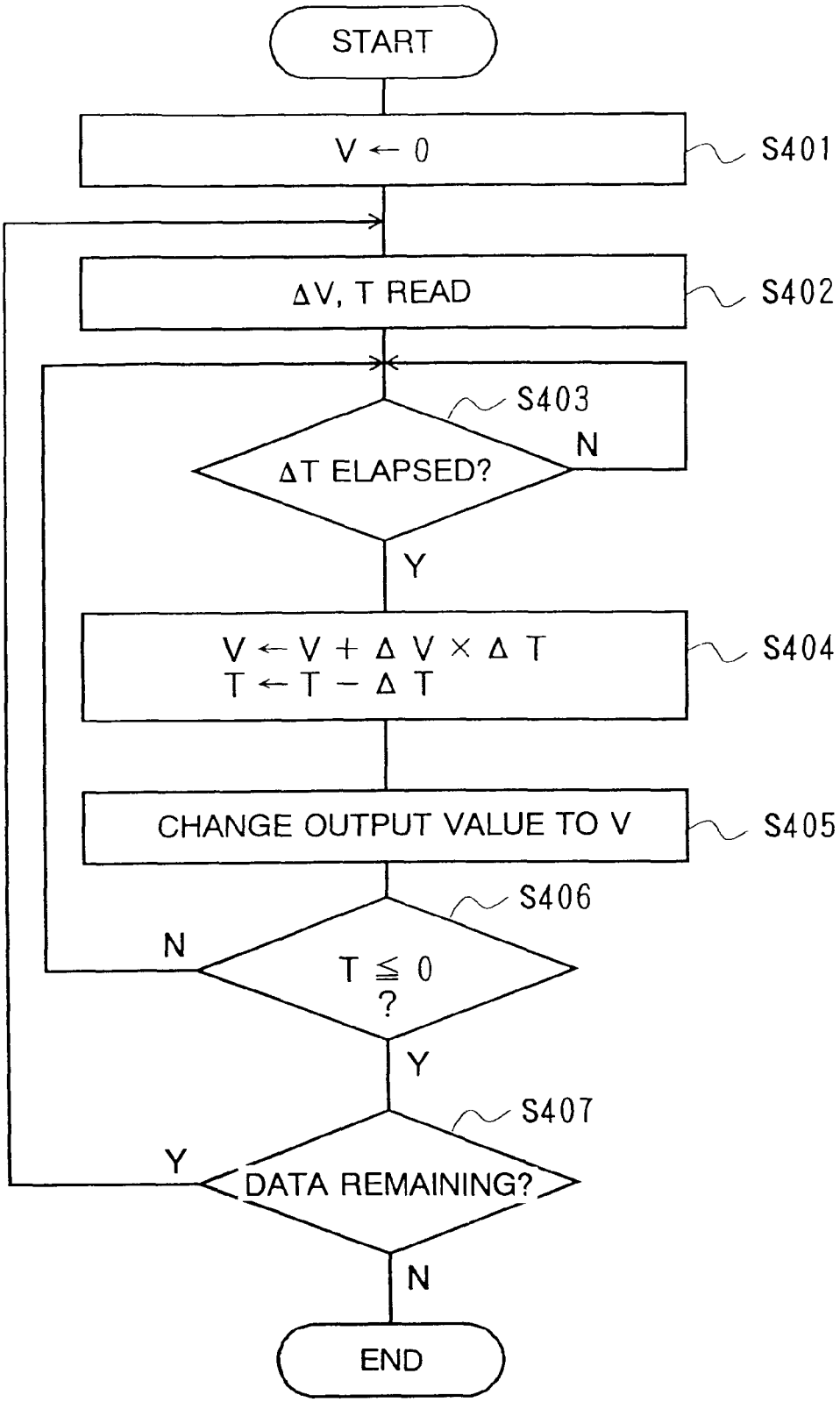
FIG. 13 is a flow chart depicting the operating sequence of the head drive waveform generation device when type A head drive waveform data have been presented.

Next, the operating sequence of the head drive waveform generation unit 202 will be described using FIG. 13 for a case in which type A head drive waveform data have been stored.

In this case, the head drive waveform generation unit 202 assigns "0" to V, which is a variable for specifying the value of the digital signal being outputted (step S401). The head drive waveform generation unit 202 subsequently reads the initial waveform data element (inclination value ΔV and interval width T) stored in the waveform data storage unit 201 (step S402).

The head drive waveform generation unit 202 subsequently waits until a preset time ΔT has elapsed (step S403; N). When ΔT has elapsed (step S403; Y), the head drive waveform generation unit 202 adds ΔV×ΔT to V, subtracts ΔT from T (step S404), and changes the magnitude of the outputted digital signal to V (step S405). The head drive waveform generation unit 202 subsequently determines whether or not T is "0" or less, and returns to step S403 if T is not "0" or less (step S406; N). On the other hand, when T is "0" or less (step S406; Y), it is determined whether or not unused waveform data elements have remained in the waveform data storage unit 201 (step S407). If such unused waveform data elements have remained (step S407; Y), the head drive waveform generation unit 202 returns to step S402 and reads the next waveform data element.

The head drive waveform generation unit 202 completes head drive waveform generation and processing when there are no more unused waveform data elements in the waveform data storage unit 201 (step S407; N).

Thus, the head drive waveform generation unit 202 performs processing that corresponds to the type of head drive waveform data presented.

Figures 14, 15:
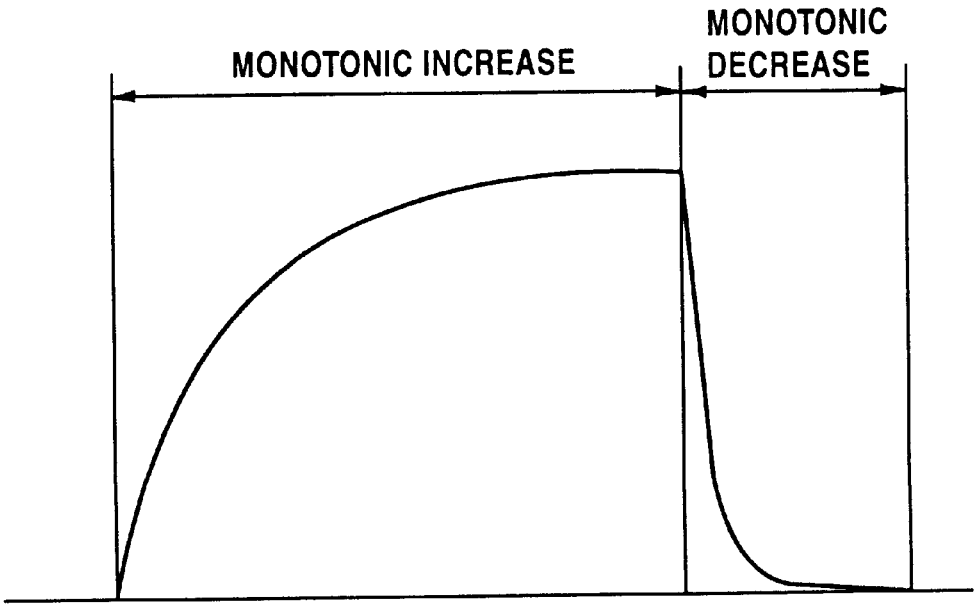
FIG. 14 is a diagram depicting an example of a waveform data element contained in type A head drive waveform data.
FIG. 15 is a diagram depicting an example of a head drive waveform.

The decision as to which type of data to use as the head drive waveform data that corresponds to a head drive waveform is made in accordance with the size of the head drive waveform data generated. For example, as has already been described above, it is sufficient to prepare the type B head drive waveform data shown in FIG. 11 when the head drive waveform generation device 200 generates the head drive waveform shown in FIG. 12, but the head drive waveform generation device 200 can generate the head drive waveform shown in FIG. 12 by means of the type A head drive waveform data shown in FIG. 14. However, type A head drive waveform data (21 bytes: type data+five inclination values+type data+three inclination values+three pieces of counting data+five interval widths) is larger in size than type B head drive waveform data (20 bytes: type data+three inclination values+three pieces of counting data+five interval widths), so type B head drive waveform data are first created for the head drive waveform shown in FIG. 12.

The difference in size between these two cases is 1 byte, but because actual head drive waveform data involve approximating a head drive waveform with a larger number of line segments, the difference in size between these two types of head drive waveform data is further increased. For example, type B head drive waveform data are 5 bytes smaller than type A head drive waveform data when type A head drive waveform data that produce the same results as type B head drive waveform data (consisting of a first waveform data element waveform having a single interval width, and second and third waveform data elements having three interval widths) are generated.

For this reason, type B head drive waveform data are created in advance for a common head drive waveform, and when such type B head drive waveform data have been created, type A head drive waveform data are created only for a special head drive waveform, such as that in which each waveform data element contains a single interval width.

As described in detail above, the head drive waveform generation device 200 computes the voltage values to be outputted for the times for which no voltage values have been defined, and outputs the voltages in accordance with the computation results. The computation is performed based on type A or type B head drive waveform data that serve as data for determining the coordinate values of several points in time/voltage coordinates. Specifically, the head drive waveform generation device 200 is designed in such a way that head drive waveforms for driving the print head can be generated on the basis of head drive waveform data that are smaller in size than conventional head drive waveform data. As a result, the present head drive waveform generation device 200 makes it possible to lower printing costs because large-capacity memory is no longer needed to store head drive waveform data.

It is apparent that, in this invention, a wide range of different working modes can be formed based on the invention without deviating from the spirit and scope of the invention. This invention is not restricted by its specific working modes except being limited by the appended claims.

What is claimed is:

1. A head drive waveform generation device for outputting head drive waveforms used for driving a print head, wherein the head drive waveform generation device comprises:

storage means for storing waveform data that express the positions of a plurality of points in time/signal value coordinates in the form of inclination values and interval widths; and waveform output means for generating signals that express temporal changes in the signal values by means of a plurality of line segments obtained when the points whose positions are expressed by the waveform data stored in the storage means are connected by line segments in the order of values along the time axis, and outputting the result as a head drive waveform.

2. A head drive waveform generation device for generating head drive waveforms used for driving a print head, wherein the head drive waveform generation device comprises:

storage means for storing a plurality of waveform data elements that comprise inclination values, which provide information specifying signal changes per unit of time, and interval widths, which provide information specifying time intervals during which the inclination values are used;

reading means for the sequential reading of the plurality of waveform data elements stored in the storage means;

generation means for generating digital signals whose magnitude varies over time in accordance with the inclination values within the waveform data elements that have been read by the reading means, during the time intervals specified by the interval widths within the waveform data elements; and waveform outputting means for outputting, in the form of head drive waveforms, analog signals whose magnitude corresponds to the digital signals generated by the generation means.

3. A head drive waveform generation device as defined in claim 2, wherein the waveform outputting means comprises:

contrast conversion means for extracting, from the most significant bits of the digital signals generated by the generation means, data whose number of bits corresponds to contrast-specifying data; and signal conversion means for outputting analog signals whose magnitude corresponds to the digital signals extracted by the contrast conversion means.

4. A head drive waveform generation device for outputting head drive waveforms used for driving a print head, wherein the head drive waveform generation device comprises:

storage means for storing a plurality of waveform data elements that comprise inclination values, which provide information specifying signal changes per unit of time, and several interval widths, which provide information corresponding to these inclination values and specifying the corresponding time intervals;

reading means for the sequential reading of the plurality of waveform data elements stored in the storage means;

generation means for generating digital signals whose magnitude varies over time in accordance with the inclination values within the waveform data elements that have been read by the reading means, during the time interval specified by the initial interval width, which is one of the several interval widths within the waveform data elements, and for generating digital signals whose magnitude varies over time in accordance with the results obtained by performing prescribed operations on the inclination values during the time interval specified by the second and subsequent interval widths within the waveform data elements; and waveform outputting means for outputting, in the form of head drive waveforms, analog signals whose magnitude corresponds to the digital signals generated by the generation means.

5. A head drive waveform generation device as defined in claim 3, wherein the waveform outputting means comprises:

contrast conversion means for extracting, from the significant bits of the digital signals generated by the generation means, data whose number of bits corresponds to contrast-specifying data; and signal conversion means for outputting analog signals whose magnitude corresponds to the digital signals extracted by the contrast conversion means.

6. A head drive waveform generation method for outputting head drive waveforms used for driving a print head, wherein the head drive waveform generation method comprises:

an input step for inputting waveform data that express the positions of a plurality of points in time/signal value coordinates in the form of inclination values and interval widths; and a waveform output step for generating signals that express temporal changes by means of a plurality of line segments obtained when the points whose positions are expressed by the waveform data that have been inputted during the input step are connected by line segments in the order of values along the time axis, and outputting the result as a head drive waveform.

7. A head drive waveform generation method for generating head drive waveforms used for driving a print head, wherein the head drive waveform generation method comprises:

an input step for inputting a plurality of waveform data elements that comprise inclination values, which provide information specifying signal changes per unit of time, and interval widths, which provide information specifying time intervals during which the inclination values are used;

a generation step for generating, for each of the plurality of waveform data elements inputted during the input step, digital signals whose magnitude varies over time in accordance with the inclination values within the waveform data elements, during the time intervals specified by the interval widths within the waveform data elements; and a waveform output step for outputting, in the form of head drive waveforms, analog signals whose magnitude corresponds to the digital signals generated during the generation step.

8. A head drive waveform generation method for outputting head drive waveforms used for driving a print head, wherein the head drive waveform generation method comprises:

an input step for inputting a plurality of waveform data elements that comprise inclination values, which provide information specifying signal changes per unit of time, and several interval widths, which provide information corresponding to these inclination values and specifying the corresponding time intervals;

a generation step for generating, for each of the plurality of waveform data elements inputted during the input step, digital signals whose magnitude varies over time in accordance with the inclination values within the waveform data elements, during the time interval specified by the initial interval width, which is one of the several interval widths within the waveform data elements, and for generating digital signals whose magnitude varies over time in accordance with the results obtained by performing prescribed operations on the inclination values during the time interval specified by the second and subsequent interval widths within the waveform data elements; and a waveform output step for outputting, in the form of head drive waveforms, analog signals whose magnitude corresponds to the digital signals generated during the generation step.

9. A head drive waveform generation method as defined in claim 7, wherein the waveform output step comprises:

a contrast conversion step for extracting, from the significant bits of the digital signals generated during the generation step, data whose number of bits corresponds to contrast-specifying data; and a signal conversion step for outputting analog signals whose magnitude corresponds to the digital signals extracted during the contrast conversion step.

10. A head drive waveform generation method as defined in claim 8, wherein the waveform output step comprises:

a contrast conversion step for extracting, from the significant bits of the digital signals generated during the generation step, data whose number of bits corresponds to contrast-specifying data; and a signal conversion step for outputting analog signals whose magnitude corresponds to the digital signals extracted during the contrast conversion step.

11. A head drive waveform generation device for outputting head drive waveforms used for driving a print head, wherein the head drive waveform generation device comprises:

selection means for selecting a type of head drive waveform data to generate;

storage means for storing waveform data that express the positions of a plurality of points in time/signal value coordinates in the form of inclination values and interval widths; and waveform output means for generating, based on a selected type of head drive waveform data, signals that express temporal changes in the signal values by means of a plurality of line segments obtained when the points whose positions are expressed by the waveform data stored in the storage means are connected by line segments in the order of values along the time axis, and outputting the result as a head drive waveform.

12. A head drive waveform generation device for generating head drive waveforms used for driving a print head , wherein the he ad drive waveform gene ration device comprises:

selection means for selecting a type of head drive waveform data to generate;

storage means for storing a plurality of waveform data elements that comprise inclination values, which provide information specifying signal changes per unit of time, and interval widths, which provide information specifying time intervals during which the inclination values are used;

reading means for the sequential reading of the plurality of waveform data elements stored in the storage means;

generation means for generating, based on a selected type of head drive waveform data, digital signals whose magnitude varies over time in accordance with the inclination values within the waveform data elements that have been read by the reading means, during the time intervals specified by the interval widths within the waveform data elements; and waveform outputting means for outputting, in the form of head drive waveforms, analog signals whose magnitude corresponds to the digital signals generated by the generation means.

13. A head drive waveform generation device for outputting head drive waveforms used for driving a print head, wherein the head drive waveform generation device comprises:

selection means for selecting a type of head drive waveform data to generate;

storage means for storing a plurality of waveform data elements that comprise inclination values, which provide information specifying signal changes per unit of time, and several interval widths, which provide information corresponding to these inclination values and specifying the corresponding time intervals;

reading means for the sequential reading of the plurality of waveform data elements stored in the storage means;

generation means for generating, based on a selected type of head drive waveform data, digital signals whose magnitude varies over time in accordance with the inclination values within the waveform data elements that have been read by the reading means, during the time intervals specified by the initial interval width, which is one of the several interval widths within the waveform data elements, and for generating digital signals whose magnitude varies over time in accordance with the results obtained by performing prescribed operations on the inclination values during the time interval specified by the second and subsequent interval widths within the waveform data elements; and waveform outputting means for outputting, in the form of head drive waveforms, analog signals whose magnitude corresponds to the digital signals generated by the generation means.

14. A head drive waveform generation method for outputting head drive waveforms used for driving a print head, wherein the head drive waveform generation device comprises:

a selection step for selecting a type of head drive waveform data to generate;

an input step for inputting waveform data that express the positions of a plurality of points in time/signal value coordinates in the form of inclination values and interval widths; and a waveform output step for generating, based on a selected type of head drive waveform data, signals that express temporal changes by means of a plurality of line segments obtained when the points whose positions are expressed by the waveform data that have been inputted during the input step are connected by line segments in the order of values along the time axis, and outputting the result as a head drive waveform.

15. A head drive waveform generation method for generating head drive waveforms used for driving a print head, wherein the head drive waveform generation method comprises:

a selection step for selecting a type of head drive waveform data to generate;

an input step for inputting a plurality of waveform data elements that comprise inclination values, which provide information specifying signal changes per unit of time, and interval widths, which provide information specifying time intervals during which the inclination values are used;

a generation step for generating, based on a selected type of head drive waveform data and for each of the plurality of waveform data elements inputted during the input step, digital signals whose magnitude varies over time in accordance with the inclination values within the waveform data elements, during the time intervals specified by the interval widths within the waveform data elements; and a waveform output step for outputting, in the form of head drive waveforms, analog signals whose magnitude corresponds to the digital signals generated during the generation step.

16. A head drive waveform generation method for outputting head drive waveforms used for driving a print head, wherein the head drive waveform generation method comprises:

a selection step for selecting a type of head drive waveform data to generate;

an input step for inputting a plurality of waveform data elements that comprise inclination values, which provide information specifying signal changes per unit of time, and several interval widths, which provide information corresponding to these inclination values and specifying the corresponding time intervals;

a generation step for generating, based on a selected type of head drive waveform data and for each of the plurality of waveform data elements inputted during the input step, digital signals whose magnitude varies over time in accordance with the inclination values within the waveform data elements, during the time interval specified by the initial interval width, which is one of the several interval widths within the waveform data elements, and for generating digital signals whose magnitude varies over time in accordance with the results obtained by performing prescribed operations on the inclination values during the time interval specified by the second and subsequent interval widths within the waveform data elements; and a waveform output step for outputting, in the form of head drive waveforms, analog signals whose magnitude corresponds to the digital signals generated during the generation step.

* * * * *